US006708766B2

(12) United States Patent
Clark

(10) Patent No.: US 6,708,766 B2
(45) Date of Patent: Mar. 23, 2004

(54) WELLHEAD ASSEMBLY FOR COMMUNICATING WITH THE CASING HANGER ANNULUS

(75) Inventor: Alan Murray Clark, Aberdeen (GB)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 10/305,558

(22) Filed: Nov. 27, 2002

(65) Prior Publication Data

US 2003/0111229 A1 Jun. 19, 2003

Related U.S. Application Data

(60) Provisional application No. 60/333,550, filed on Nov. 27, 2001.

(51) Int. Cl.[7] ..... E21B 29/12

(52) U.S. Cl. ..... 166/368; 166/75.15; 166/90.1; 166/347; 175/66

(58) Field of Search ..... 166/368, 75.15, 166/90.1, 89.1, 344, 347; 175/5, 66, 207, 209, 210, 215, 218

(56) References Cited

U.S. PATENT DOCUMENTS

| | | | | | |
|---|---|---|---|---|---|
| 3,646,607 | A | * | 2/1972 | Dower | 261/59 |
| 3,747,696 | A | * | 7/1973 | Wenneborg et al. | 175/87 |
| 5,085,277 | A | | 2/1992 | Hopper | |
| 5,226,478 | A | * | 7/1993 | Henderson et al. | 166/285 |
| 5,310,006 | A | * | 5/1994 | Freitas et al. | 166/339 |
| 5,366,017 | A | | 11/1994 | Voss, Jr. | |
| 5,544,707 | A | | 8/1996 | Hopper et al. | |
| 5,662,169 | A | | 9/1997 | Hosie | |
| 6,186,239 | B1 | | 2/2001 | Monjure et al. | |
| 6,394,194 | B1 | | 5/2002 | Queen et al. | |
| 6,484,807 | B2 | * | 11/2002 | Allen | 166/368 |
| 6,494,267 | B2 | * | 12/2002 | Allen | 166/347 |
| 6,516,861 | B2 | * | 2/2003 | Allen | 166/351 |
| 6,571,877 | B1 | * | 6/2003 | Van Bilderbeek | 166/339 |
| 2002/0062964 | A1 | | 5/2002 | Allen | |
| 2002/0062965 | A1 | | 5/2002 | Allen | |
| 2002/0062966 | A1 | | 5/2002 | Allen | |

FOREIGN PATENT DOCUMENTS

| | | |
|---|---|---|
| WO | WO 02/44516 A1 | 6/2002 |

* cited by examiner

*Primary Examiner*—Thomas B. Will
*Assistant Examiner*—Thomas A. Beach
(74) *Attorney, Agent, or Firm*—Bracewell & Patterson, L.L.P.

(57) ABSTRACT

A subsea wellhead assembly has the capabilities of communicating from the outer surface of an outer wellhead housing to a casing annulus. Seals between the outer and inner wellhead housings define an annular chamber when the inner wellhead housing lands. The outer wellhead housing has a communication port formed through one of its sidewalls. The inner wellhead housing has a passageway extending from the annular chamber to the bore of the inner wellhead housing. The casing annulus located radially inward of the inner wellhead housing is in communication with the outer surface of the outer wellhead housing through the passageway, the annular chamber between the seals, and the communication port.

19 Claims, 3 Drawing Sheets

WELLHEAD ASSEMBLY FOR COMMUNICATING WITH THE CASING HANGER ANNULUS

RELATED APPLICATIONS

Applicant claims priority to the application described herein through a United States provisional patent application titled "Drill Cuttings Injection System," having U.S. patent application Ser. No. 60/333,550, which was filed on Nov. 27, 2001, and which is incorporated herein by reference in its entirety.

BACKGROUND OF THE INVENTION

1. Technical Field

This invention relates in general to the communication from a casing annulus to the outer wellhead housing, and more particularly to the monitoring of casing annulus pressure, the injection of drill cuttings generated from drilling a subsea well, or the injection of a heavy fluid into the casing annulus to reduce the casing annulus pressure.

2. Background of the Invention

A subsea well that is capable of producing oil or gas will have an outer or low pressure wellhead housing secured to a string of conductor pipe which extends some short depth into the well. An inner or high pressure wellhead housing lands in the outer wellhead housing. The high pressure wellhead housing is secured to an outer string of casing, which extends through the conductor pipe to a deeper depth into the well. Depending on the particular conditions of the geological strata above the target zone (typically, either an oil or gas producing zone or a fluid injection zone), one or more additional casing strings will extend through the outer string of casing to increasing depths in the well until the well is to the final depth.

The last string of casing extends into the well to the final depth, this being the production casing. The strings of casing between the first casing and the production casing are intermediate casing strings. When each string of casing is hung in the wellhead housing, a cement slurry is flowed through the inside of the casing, out of the bottom of the casing, and back up the outside of the casing to a predetermined point.

Virtually all producing wells monitor pressure in the annulus flow passage between the strings of casings. Normally there should be no pressure in the annulus between each string of casing because the annular space between each string of casing and the next larger string of casing is ordinarily cemented at its lower end and sealed with a packoff. If pressure increased within an annulus between the strings of casings, it would indicate that a leak exists in one of the strings of casing. The leak could be from several places. Regardless of where the leak is coming from, pressure build up in the annulus could collapse a portion of the production casing, compromising the structural and pressure integrity of the well. For this reason, operators monitor the pressure in the annulus between the production casing and the next larger string of casing in a well.

It is advantageous to be able to have a way to efficiently communicate with a casing inside of a high pressure or inner wellhead housing. Operators need the capability to pump down a heavy fluid into the casing annulus of a well in order to reduce casing annulus pressure. It is also desirous for operators to monitor an annular pressure between the high pressure wellhead housing and a string of casing positioned inside of the wellhead housing. Furthermore, operators also desire an efficient way to inject "cuttings" into the casing annulus of the well.

When a subsea well is drilled, cuttings, which are small chips and pieces of various earth formations, will be circulated upward in the drilling mud to the drilling vessel. These cuttings are separated from the drilling mud and the drilling mud is pumped back into the well, maintaining continuous circulation while drilling. The cuttings in the past have been dumped back into the sea or conveyed to a disposal site on land.

While such practice is acceptable for use with water based drilling muds, oil based drilling muds have advantages in some earth formations. The cuttings would be contaminated with the oil, which would result in pollution if dumped back into the sea. As a result, environmental regulations now prohibit the dumping into the sea of cuttings produced from oil based muds.

There have been various proposals to dispose of the oil based cuttings. One proposal is to inject the cuttings back into a well. The well could be the well being drilled, or the well could be an adjacent subsea well. Various proposals in patents suggest pumping the cuttings down an annulus between two sets of casing into an annular space in the well that has a porous formation. The cuttings would be ground up into a slurry and injected into the porous earth formation. Subsequently, the well receiving the injected cuttings would be completed into a production well.

U.S. Pat. No. 5,085,277, Feb. 4, 1992, Hans P. Hopper, shows equipment for injecting cuttings into an annulus surrounding casing. The equipment utilizes piping through the template or guidebase and through ports in specially constructed inner and outer wellhead housings. Orientation of the inner wellhead housing with the outer wellhead housing is required to align the ports. In the '277 patent, orientation is not discussed, but it appears that it would require rotating the string of casing attached to the inner wellhead housing, which would be difficult. Another known injection system avoids having to rotate the string of casing attached to the inner wellhead housing by running the casing first, supporting it on a landing ring, then on a second trip running the inner wellhead housing assembly. The inner wellhead housing assembly has a port which is oriented. The inner wellhead housing is then secured to the string of casing. While workable, this requires two trips to run the inner wellhead housing and string of casing, which is time consuming for deep water drilling.

U.S. Pat. No. 5,662,129, Sep. 2, 1997, Stanley Hosie, shows equipment with specially manufactured extensions attached between the lower portions of both the inner and outer wellhead housings and the upper portions of the casings hanging therefrom. Each of the extensions have ports that must align in order for the cuttings to communicate through the inner and outer wellhead housings to an annular space inside of the inner wellhead housing. A swivel joint on the extension of the inner wellhead housing supports the casing hanging therefrom while allowing rotation of the inner casing above the swivel joint for aligning ports extending through each of the inner and outer wellhead housings.

U.S. Pat. No. 6,394,194, May 28, 2002, Michael Queen et al., shows equipment with a port formed in a collar that aligned with a passage in an inner wellhead housing above the outer wellhead housing. Having the communication port in the collar positioned above the outer wellhead housing was one way to remove the necessity of aligning a port on the inner wellhead housing with a port on the outer wellhead housing. The collar, however, had to be aligned with the passageway opening to the outer surface of the inner wellhead housing, and then the injector system had to align with the port formed in the collar. This necessitated the use of two brackets that had to land around the inner wellhead housing after the inner wellhead housing had landed.

U.S. Pat. No. 5,366,017, Nov. 22, 1994, Robert K. Voss, Jr., and U.S. Pat. No. 5,544,707, Aug. 13, 1996, Hans P. Hopper et al., both show equipment for monitoring casing annulus pressure. The inventions disclosed in both of these patents show equipment that has the casing annulus pressure communicating to a point above the high pressure wellhead housing on the exterior of a tree assembly that has landed on the high pressure wellhead housing. Various systems have been utilized in order to prevent the casing annulus from communicating until the tree assembly lands on the high pressure wellhead housing. With the equipment shown in the Hopper and Voss patents, it is difficult to monitor the casing annulus pressure before the tree assembly lands.

U.S. Pat. No. 6,186,239, Feb. 13, 2001, Noel A. Monjure et al., shows equipment for circulating heavy fluids into an annulus formed between casing strings in order to relieve casing pressure due to leaks. The invention disclosed in the Monjure '239 patent shows injecting heavy fluids into a well by lowering a flexible hose into an annulus between casing strings. Heavy fluids are pumped through the hose and into the annulus for well fluid displacement when the pressure builds up in the annulus between casing strings due to leaks in the casing.

SUMMARY OF THE INVENTION

A subsea wellhead assembly has the capabilities of communicating from the outer surface of an outer, low pressure wellhead housing to an annulus located inside of an inner, high pressure wellhead housing. The subsea wellhead has an outer wellhead housing and an inner wellhead housing. The inner wellhead housing has a bore and a lower portion that lands in the outer wellhead housing. A pair of seals between the outer and inner wellhead housings define an annular chamber when the inner wellhead housing lands in the outer wellhead housing. The outer wellhead housing has a communication port extending through a side of the outer wellhead housing. The inner wellhead housing has a passageway extending from the annular chamber to the bore of the inner wellhead housing for communicating with a casing annulus.

The casing annulus located circumferentially inward of the inner wellhead housing is in communication with the annular chamber on the outside of the inner wellhead housing. The annular chamber is in communication with the outer surface of the outer wellhead housing through the communication port. Therefore, the casing annulus is in communication with the outer surface of the wellhead housing. The operator can monitor casing annulus pressure, inject heavy fluid into the casing annulus, or inject cuttings from the outer surface of the outer wellhead housing to the casing annulus.

In the preferred embodiment, a wear resistant surface is formed on the outer surface of the inner wellhead housing. Preferably, the wear resistant surface is located axially at substantially the same position as the communication port. The wear resistant surface can reduce the damage to the surface of the inner wellhead housing when injecting cuttings from the communication port.

In the preferred embodiment, the subsea wellhead assembly also has an injection mechanism for injecting a slurry of cuttings or a heavy fluid into the well. The injection mechanism typically has a frame with a manifold, or support member, that extends partially around the outer wellhead housing. The injection mechanism also has a flowline connector for communicating with the communication port. A flowline may communicate a slurry of cuttings or a heavy fluid to the flowline connector from another location. The flowline connector typically has an end that operably seals and engages with the communication port and an end for receiving the slurry of cuttings or the heavy fluid from a flowline. The injection mechanism also has a plurality of lock members on the manifold, or support member, that move into engagement with a mating profile on an exterior surface of the outer wellhead housing. In the preferred embodiment, the frame aligns to receive the outer wellhead housing with a pair of sleeves that slidingly receive a pair of guidelines.

DETAILED DESCRIPTION OF THE PREFERRED EMBODIMENT

Figure 2:
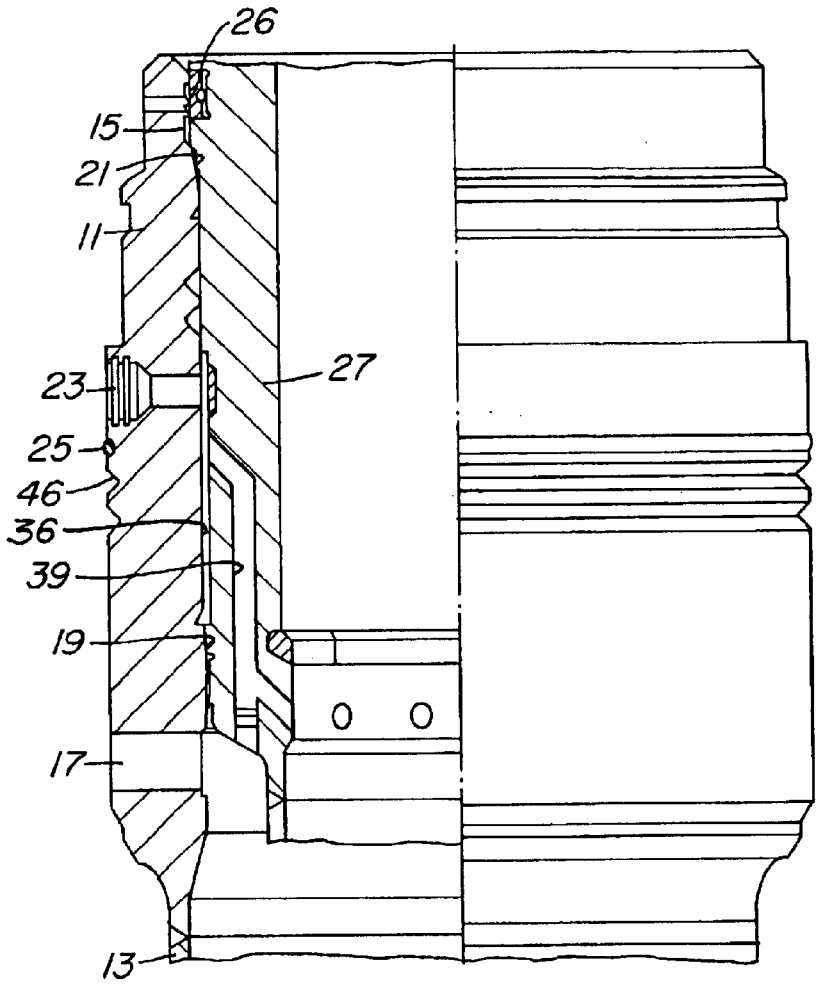
FIG. 2 is a cross-sectional view of an outer or low pressure wellhead housing receiving the high pressure wellhead housing of FIG. 1.

Referring to FIG. 2, an outer or low pressure wellhead housing 11 is shown with one-half in section and the other half in a side elevation view. Outer wellhead housing 11 is located at the sea floor and has a conductor 13 that extends into the well bore for a first depth. Outer wellhead housing 11 has a bore 15 and a plurality of ports 17 leading from bore 15 to the exterior for cement returns. Bore 15 has two tapered or conical surfaces 19, 21 spaced axially apart from each other.

A communication port or injection port 23 extends through the side wall of outer wellhead housing 11 between conical surfaces 19 and 21 and above cement return ports 17. An annular seal 25 extends around wellhead housing 11 below communication port 23. A plurality of grooves 26 are formed in bore 15 near the upper end.

Figure 1:
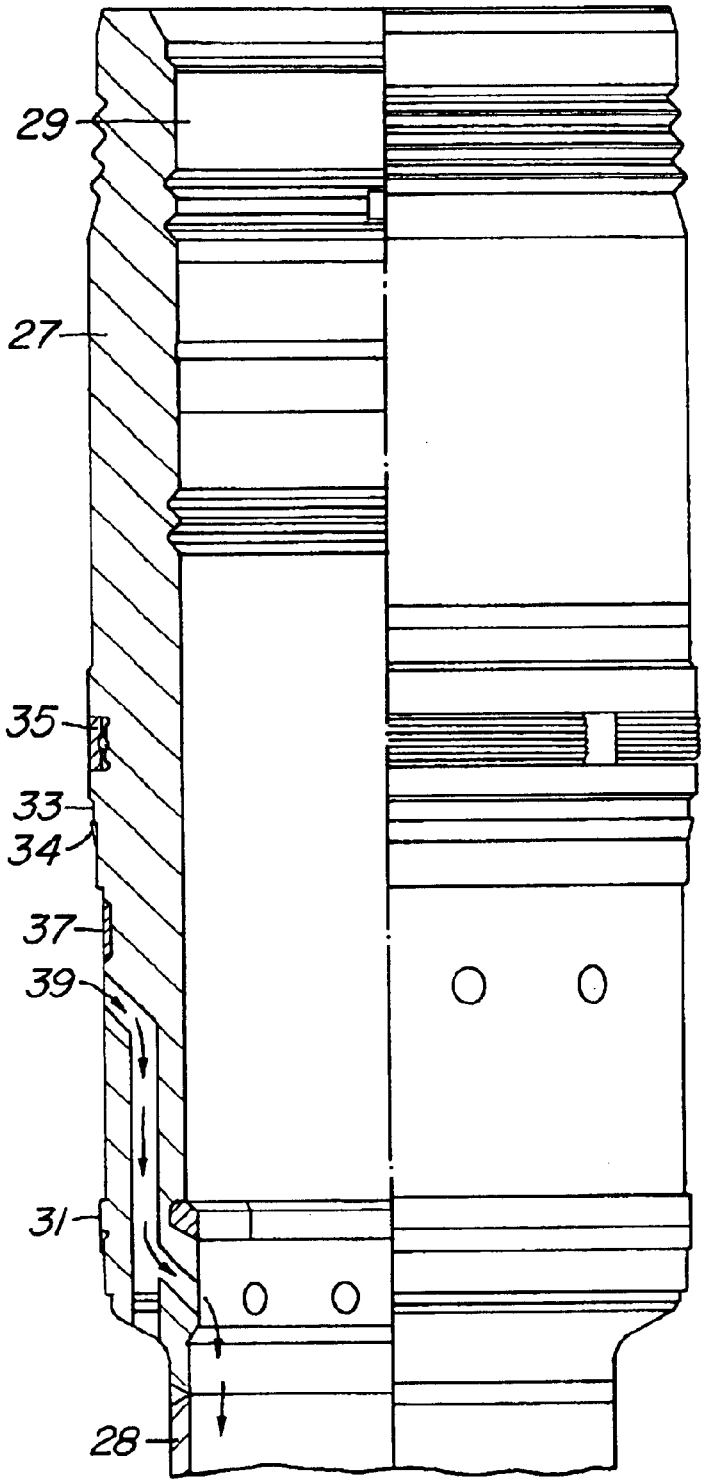
FIG. 1 is a cross-sectional view of an inner or high pressure wellhead housing constructed in accordance with this invention.

After outer wellhead housing 11 and conductor 13 are installed, a high pressure or inner wellhead housing 27 will be lowered into bore 15. A portion of high pressure wellhead housing 27 is shown in FIG. 2, and the complete high pressure wellhead housing 27 is shown in FIG. 1. High pressure wellhead housing 27 is secured to a string of casing 28 that extends into the well a deeper depth than conductor 13 (FIG. 2). High pressure wellhead housing 27 has a bore 29 that extends through it. Tapered annular surfaces 31, 33 are located on the exterior of high pressure wellhead housing 27 and spaced apart for mating with conical surfaces 19, 21 of low pressure wellhead housing 11 (FIG. 2). Tapered surfaces 31, 33 wedge tightly with conical surfaces 19, 21 in bore 15. An elastomeric seal 34 is preferably located on each tapered surface 31, 33 for forming seals between high pressure wellhead housing 27 and low pressure wellhead housing 11 at these points. Metal-to-metal seals could also be utilized at tapered surfaces 31, 33. High pressure wellhead housing 27 has a latch 35 located above uppermost tapered surface 33 for latching into grooves 26 (FIG. 2).

Once high pressure wellhead housing 27 is installed in low pressure wellhead housing 11, communication port 23 (FIG. 2) will be in communication with an annular chamber 36 that is sealed at its upper and lower ends by seals 34. A wear resistant surface or wear plate 37 of hard facing is formed on the exterior of high pressure wellhead housing 27 in alignment with communication port 23 (FIG. 2) of low pressure wellhead housing 11. Wear plate 37 preferably extends in a band around the circumference of inner wellhead housing 27 inward of communication port 23, although it could be a circular disk.

A plurality of passages 39 extend through the side wall of high pressure wellhead housing 27. Each passage 39 begins between the two tapered surfaces 31, 33, leads downward, and then exits in bore 29. A casing hanger with a string of casing (not shown) lands in bore 29 after high pressure wellhead housing 27 lands. A seal for the casing hanger is located circumferentially around the outer surface of the casing hanger and above the exits of passages 39. The bore of high pressure wellhead housing 27, the casing hanger with a string of casing (not shown), and the seal for the casing hanger define a casing annulus. Passages 39 serve to deliver a slurry of cuttings from an adjacent well being drilled down passages 39 and into the casing annulus between casing 28 and the next inward casing (not shown).

Figure 4:
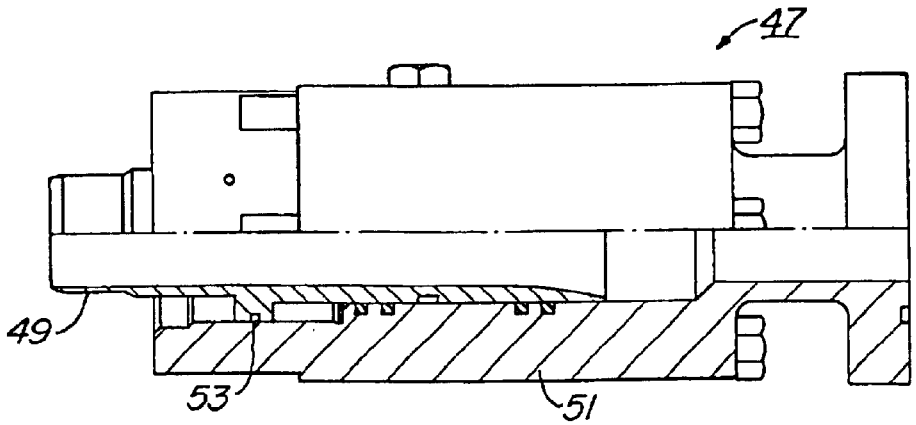
FIG. 4 is a partially sectional view of a penetrator assembly for use with the injection mechanism of FIG. 3.
Figure 3:
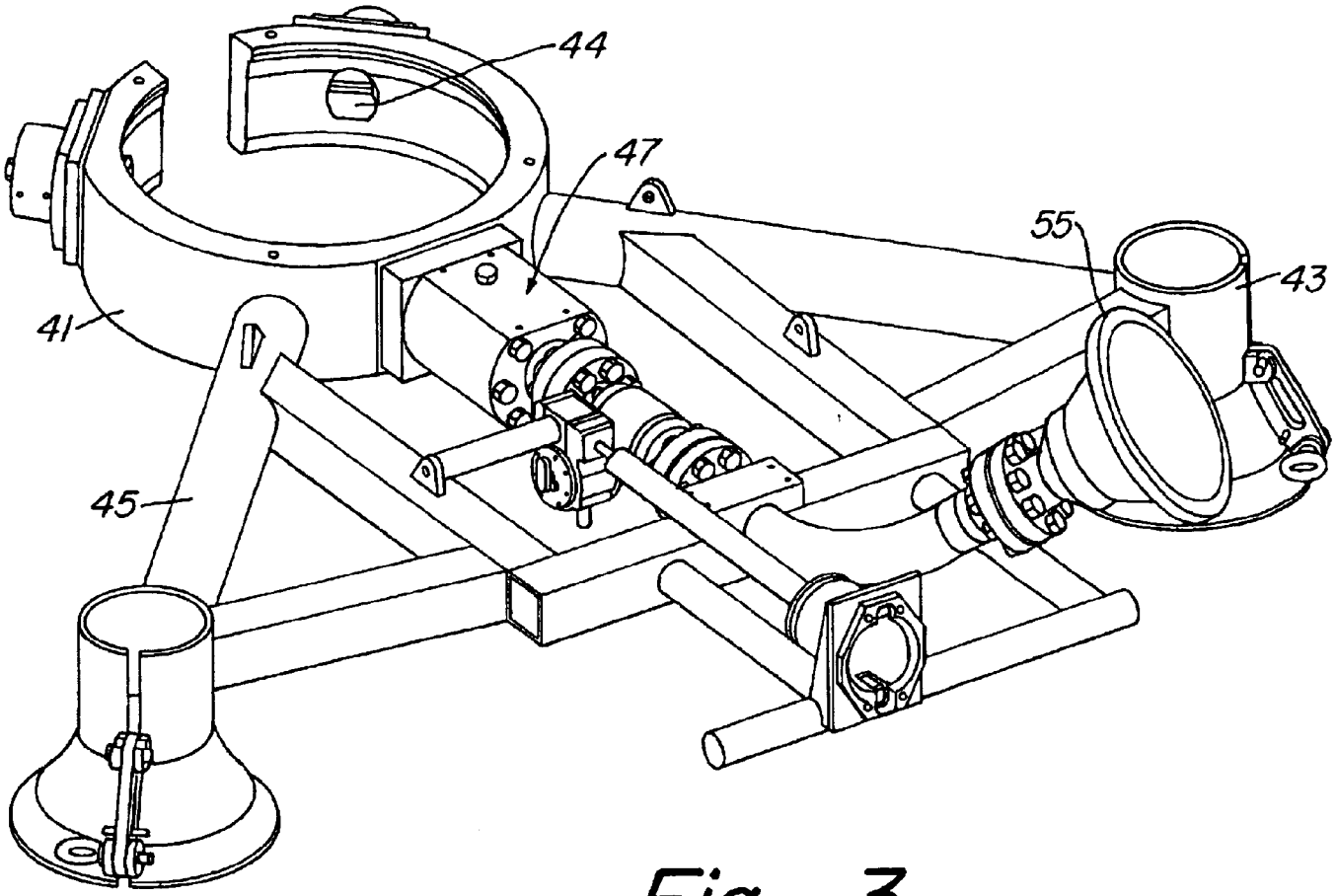
FIG. 3 is a perspective view of an injection mechanism for installation on the low pressure wellhead housing of FIG. 2.

FIGS. 3 and 4 illustrate equipment for injecting the cuttings into communication port 23 (FIG. 2). The assembly includes a ring 41 mounted to a guide frame 45 that has sleeves 43. Guide frame 45 extends laterally from ring 41. The assembly is lowered on guidelines (not shown) over low pressure wellhead housing 11 after high pressure wellhead housing 27 has been installed. Ring 41 will locate on and seal to low pressure wellhead housing 11 at seal 25, covering communication port 23 (FIG. 2). Guidelines extend upward from guideposts (not shown) and pass through sleeves 43. Guideposts are located around low pressure wellhead 11 (FIG. 2). Ring 41 has a plurality of lock members 44 that are movable between an unlocked position and a locked position in engagement with mating grooves 46 (FIG. 2) on the exterior of low pressure wellhead housing 11.

A penetrator assembly 47 is mounted to ring 41 in this embodiment, which serves as a support member to hold penetrator assembly 47 in alignment with communication port 23 (FIG. 2). As best illustrated in FIG. 4, penetrator assembly 47 has a tubular member or sliding tube 49 that inserts into communication port 23 (FIG. 2). Tube 49 is located in the bore of a connector housing 51 and has an integral band or piston 53 formed on its sidewall. Hydraulic pressure supplied to piston 53 on one side causes tube 49 to sealingly enter communication port 23. Applying hydraulic fluid pressure to the opposite side of piston 53 causes tube 49 to retract. As shown in FIG. 3, the injection assembly may also have a funnel 55 that extends upward for guiding an umbilical from the surface for injecting a slurry of ground-up cuttings or a heavy fluid. Penetrator assembly 47 along with sliding tube 49 could alternately be mounted to a standard guidebase or frame rather than ring 41 and frame 45.

In operation, the operator drills a well to a first depth and installs low pressure wellhead housing 11 at sea floor. Then, the operator drills the well to a second depth, and lowers high pressure wellhead housing 27 from the surface on a drilling riser and blowout preventer stack. Casing 28 is secured to the lower end of high pressure wellhead housing 27. High pressure wellhead housing 27 lands in bore 15 of low pressure wellhead housing 11. Cement is pumped down casing 28, with the displaced fluid and cement returns flowing out cement return ports 17 in FIG. 2. The operator then drills the well to a greater depth, and installs a string of casing on a casing hanger (not shown).

When it is desired to inject cuttings from another well, the operator will lower the injection assembly of FIG. 3 on guidelines, which pass through sleeves 43. The drilling riser will have been previously disconnected. Sleeves 43 land on guideposts (not shown) and ring 41 will slide over low pressure wellhead housing 27. The operator supplies hydraulic fluid pressure to piston 53 to cause tube 49 to insert into communication port 23 (FIG. 2). The operator lowers an umbilical to engage funnel 55, and then begins pumping a cuttings slurry from the surface. The cuttings slurry comprises ground up cuttings from an adjacent well being drilled. The slurry flows through tube 49 (FIG. 4) and into port 23 (FIG. 2). The slurry strikes wear plate 37 and then flows downward into passages 39. The slurry flows into the casing annulus located between casing 28 and the next inner string of casing (not shown).

While the invention has been described in detail for injecting cuttings into the casing annulus, it would be obvious to those skilled in the art that substantially the same process could be used for injecting a heavy fluid into the casing annulus instead of the slurry of cuttings to reduce pressure in the casing annulus. Furthermore, it would also be obvious to those skilled in the art that monitoring equipment, such as pressure transducers could be connected to communication port 23 on the outer surface of high pressure housing 27 to obtain pressure readings from the casing annulus that is in communication with the casing annulus through communication port 23, the annular chamber sealed at its upper and lower ends by seals 34, and through passageway 39.

This invention advantageously allows communication with the casing annulus without having to use extension sleeves between the inner and outer wellhead housings and their respective casing strings. Additionally, wear plate 37 may reduce the wear that is typically experienced on the outer surface of inner wellhead housing 27 when fluids are injected into a well directly against the exterior of inner wellhead housing 27. The wellhead assembly also does not require a rotation of inner wellhead housing 27 in order to align inner wellhead housing 27 with communication port 23, because in the preferred embodiment wear plate 27 extends in a band around the circumference of inner wellhead housing. The wellhead assembly also does not require for proper alignment that inner wellhead housing 27 have a machined surface on its exterior that slidingly engages surfaces on the interior of the outer wellhead housing while landing. These advantages may reduce the time and expense of manufacture, installation, and repairs. Furthermore, because communication port 23 is located on the outer surface of outer wellhead housing 11, an operator may communicate with the casing annulus before a tree assembly lands on the wellhead assembly.

While the invention has been shown in only one of its forms, it should be apparent to those skilled in the art that it is not so limited, but is susceptible to various changes without departing from the scope of the invention.

What is claimed is:

1. A subsea wellhead assembly comprising:

a low pressure wellhead housing secured to a string of conductor pipe extending into the well;

a high pressure wellhead housing having a bore, a lower portion that lands in the low pressure wellhead housing, and an upper portion that extends above an upper end of the low pressure wellhead housing;

a communication port formed in the low pressure wellhead housing extending through a side of the low pressure wellhead housing;

a pair of seals between the high pressure wellhead housing and the low pressure wellhead housing, defining an annular chamber, the seals being located above and below the communication port; and a passageway extending from the annular chamber to the bore of the high pressure wellhead housing for communicating with a casing annulus.

2. The subsea wellhead assembly of claim 1, wherein the passageway enters the annular chamber at a higher elevation than where the passageway enters the bore.

3. The subsea wellhead assembly of claim 1, wherein the passageway comprises a plurality of passageways spaced around the circumference of the high pressure wellhead housing.

4. The subsea wellhead assembly of claim 1, wherein the pair of seals comprises elastomeric seals.

5. A subsea wellhead assembly comprising:

an outer wellhead housing;

an inner wellhead housing having a bore and a lower portion that lands in the outer wellhead housing;

a communication port formed in the outer wellhead housing extending through a side of the outer wellhead housing;

a pair of seals between the inner wellhead housing and the outer wellhead housing, defining an annular chamber the seals being located above and below the communication port; a passageway extending from the annular chamber to the bore of the inner wellhead housing for communicating with a casing annulus;

upper and lower upwardly facing conical surfaces formed on the inner bore of the outer wellhead housing above and below the communication port; and upper and lower downwardly facing tapered surface formed on the outer surface of the inner wellhead housing that mate with the conical surfaces on the outer wellhead housing.

6. The subsea wellhead assembly of claim 1, further comprising a wear resistant surface on the outer surface of the high pressure wellhead housing in alignment with the communication port for reducing wear due to the cuttings injected on the outer surface of the high pressure wellhead housing.

7. A subsea wellhead assembly comprising:

an outer wellhead housing;

an inner wellhead housing having a bore and a lower portion that lands in the outer wellhead housing;

a communication port formed in the outer wellhead housing extending through a side of the outer wellhead housing;

a pair of seals between the inner wellhead housing and the outer wellhead housing, defining an annular chamber the seals being located above and below the communication port; a passageway extending from the annular chamber to the bore of the inner wellhead housing for communicating with a casing annulus; and a frame having a support member that extends at least partially around the outer wellhead housing;

a flowline connector mounted to the frame for communicating with the communication port;

a plurality of lock members on the support member for movement into engagement with a mating profile on an extension of the outer wellhead housing.

8. The subsea wellhead assembly of claim 7, wherein the flowline connector has a penetrator that moves between inner and outer positions, the penetrator having an inner end that operably seals and engages the communication port and an outer end for receiving a fluid for injection into the well.

9. The subsea wellhead assembly of claim 7, wherein the frame aligns to receive the outer wellhead housing with a pair of sleeves for slidingly receiving a pair of guidelines.

10. A subsea wellhead assembly for cuttings injection, comprising:

a low pressure wellhead housing connected to a sting of conductor pipe extending into the well;

a high pressure wellhead housing having a bore, a lower portion that lands in the low pressure wellhead housing, and an upper portion that extends above an upper end of the low pressure wellhead housing;

a communication port formed in the low pressure wellhead housing extending through a side of the low pressure wellhead housing for injecting cuttings into the well;

a pair of seals above and below the communication port and between the high pressure wellhead housing and the low pressure wellhead housing, defining an annular chamber;

a plurality of passages extending from the annular chamber to the bore of the high pressure wellhead housing for communicating with a casing annulus; and a wear resistant surface on the outer surface of the high pressure wellhead housing in alignment with the communication port for reducing wear due to the cuttings injected on the outer surface of the high pressure wellhead housing.

11. The subsea wellhead assembly of claim 10, wherein the passageway has an upper end that opens into the annular chamber and a lower end that opens into the bore.

12. The subsea wellhead assembly of claim 10, wherein the pair of seals comprises elastomeric seals.

13. A subsea wellhead assembly for cuttings injection, comprising:

an outer wellhead housing;

an inner wellhead housing having a bore and a lower portion that lands in the outer wellhead housing;

a communication port formed in the outer wellhead housing extending through a side of the outer wellhead housing for injecting cuttings into the well;

a pair of seals above and below the communication port and between the inner wellhead housing and the outer wellhead housing, defining an annular chamber;

a plurality of passages extending from the annular chamber to the bore of the inner wellhead housing for communicating with a casing annulus;

a wear resistant surface on the outer surface of the inner wellhead housing in alignment with the communication port for reducing wear due to the cuttings injected on the outer surface of the inner wellhead housing;

a frame having a support member that at least partially extends around the outer wellhead housing;

a flowline connector mounted to the frame for communicating with the communication port; and a plurality of lock members on the support member for movement into engagement with a mating profile on an extension of the outer wellhead housing.

14. The subsea wellhead assembly of claim 13, wherein the flowline connector has a penetrator that moves between inner and outer positions, the penetrator having an inner end that operably seals and engages the communication port and an outer end for receiving a fluid for injection into the well.

15. The subsea wellhead assembly of claim 13, wherein the frame aligns to receive the low pressure wellhead housing with a pair of sleeves for slidingly receiving a pair of guidelines.

16. A method for communicating with a casing annulus of a wellhead assembly, comprising the following steps:

providing a high pressure wellhead housing having a passageway extending from its outer surface to its bore, and a low pressure wellhead housing secured to a string of conductor pipe extending into the well and having a communication port extending from its outer surface to its inner surface; then landing a lower portion of the high pressure wellhead housing in the low pressure wellhead housing such that an upper portion of the high pressure wellhead housing extends above an upper end of the low pressure wellhead housing; then sealing the outer surface of the high pressure wellhead housing to the inner surface of the low pressure wellhead housing above and below both the opening of the passageway on the outer surface of the high pressure wellhead housing and the communication port in the low pressure wellhead housing; and then communicating from the outer surface of the low pressure wellhead housing to the bore of the high pressure wellhead housing.

17. The method of claim 16, wherein the communicating step further comprises:

connecting a flowline connector to the communication port from the exterior of the low pressure wellhead housing; and then injecting a slurry of cuttings through flowline connector and into the casing annulus.

18. The method of claim 16, wherein the communicating step further comprises:

connecting a flowline connector to the communication port from the exterior of the low pressure wellhead housing; and then injecting a fluid through flowline connector and into the casing annulus.

19. The method of claim 16, wherein the communicating step comprises monitoring pressure in the casing annulus.

* * * * *